US007216380B2

(12) United States Patent
Vaskuthy

(10) Patent No.: US 7,216,380 B2
(45) Date of Patent: May 15, 2007

(54) CORNER GUARD FOR BOX SPRING

(76) Inventor: Istvan Vaskuthy, 1055 Bourget, St-Hyacinthe, Quebec (CA) J2S 6P7

( * ) Notice: Subject to any disclaimer, the term of this patent is extended or adjusted under 35 U.S.C. 154(b) by 0 days.

(21) Appl. No.: 11/399,205

(22) Filed: Apr. 6, 2006

(65) Prior Publication Data

US 2006/0225222 A1 Oct. 12, 2006

(30) Foreign Application Priority Data

Apr. 8, 2005 (CA) ..... 2504113

(51) Int. Cl.
*A47C 23/00* (2006.01)

(52) U.S. Cl. ..... 5/261; 5/663; 248/345.1

(58) Field of Classification Search ..... 5/260, 5/663; 248/345.1
See application file for complete search history.

(56) References Cited

U.S. PATENT DOCUMENTS 3,406,411 A * 10/1968 La Reis ..... 5/717
5,265,291 A * 11/1993 Callaway ..... 5/254
5,628,080 A * 5/1997 Quintile ..... 5/663
5,846,906 A * 12/1998 von Deyn et al. ..... 504/221
5,878,455 A * 3/1999 Patterson ..... 5/663
6,493,887 B1 * 12/2002 DeFranks et al. ..... 5/254
6,687,929 B2 * 2/2004 DeFranks et al. ..... 5/254

* cited by examiner

*Primary Examiner*—Michael Trettel
(74) *Attorney, Agent, or Firm*—Eric Fincham

(57) ABSTRACT

A corner guard arrangement for a box spring, the corner guard arrangement having first and second members formed of a sheet material and being interlocked together, the interlocking arrangement being such that the first and second members are in sliding engagement to permit adjustment for different height box springs, one end of each of the first and second members being engaged with a perimeter wire on the box spring. The arrangement permits a smooth covering of fabric material on the box spring.

10 Claims, 6 Drawing Sheets

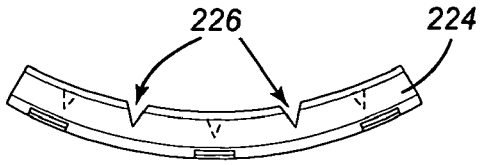
FIG. 15
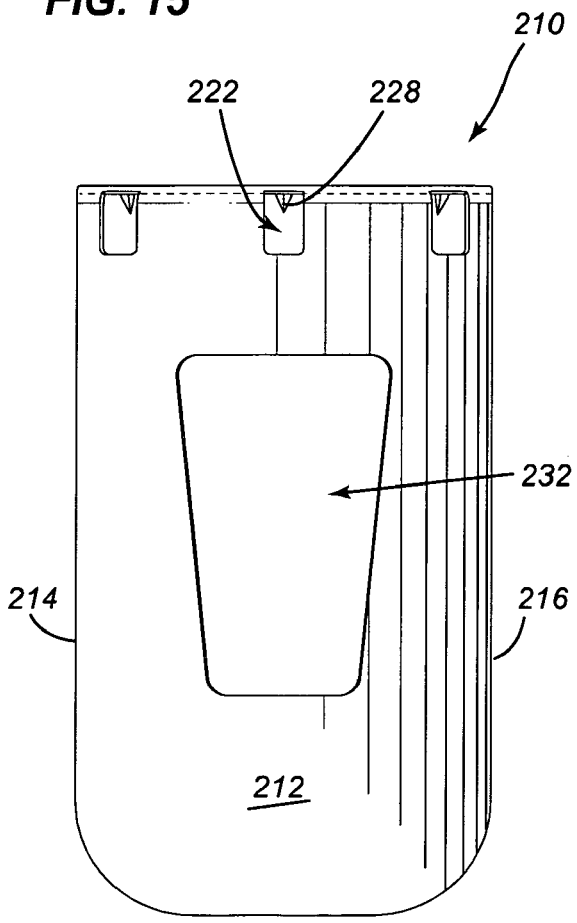
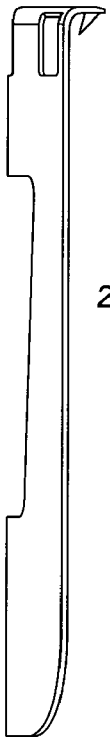
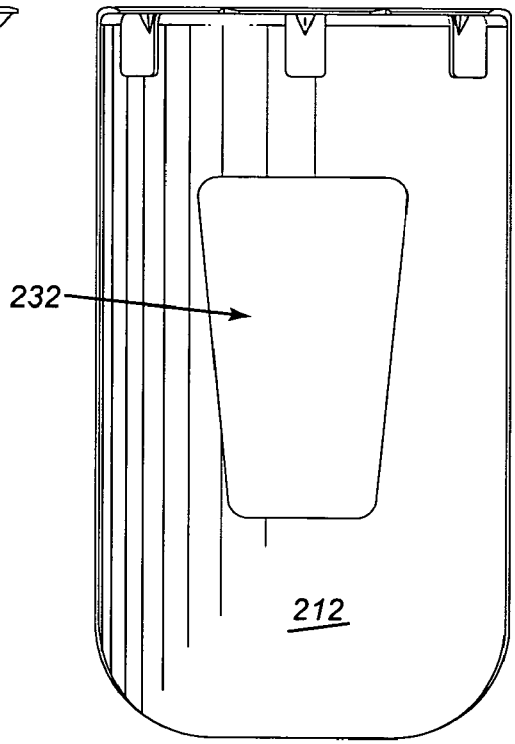
FIG. 16 FIG. 17 FIG. 18

CORNER GUARD FOR BOX SPRING

FIELD OF THE INVENTION

The present invention relates to box springs for bedding, and more particularly, relates to corner members suitable for use on box springs.

BACKGROUND OF THE INVENTION

Mattresses and box springs have been known in the art for many years. Typically, the arrangement is such that the mattress is utilized to directly support one or more people, with a box spring being in position underneath the mattress and above a supporting frame or the like. The box spring provides additional cushioning and supports the mattress and will typically include a variety of springs within its interior.

In the manufacture of box springs, the outside is covered with a fabric material. Along the sides and ends of the box spring, the fabric material may easily be stretched and held in place without problem. However, on the corners, there is a tendency for the fabric to give either inwardly or outwardly when the box spring is in use. In order to overcome this, many manufacturers provide a stuffing of a material such as scrap fiber material at the corners.

A further problem at the corner of box springs and the like is that different sizes are utilized and thus a single piece of material is not suitable.

SUMMARY OF THE INVENTION

It is an object of the present invention to provide a corner guard for box springs or the like and which corner guard is adjustable for different sizes.

It is a further object of the present invention to provide a corner guard for box springs or the like and which corner guard has means for securing a fabric adjacent thereto.

It is a still further object of the present invention to provide a corner guard for box springs or the like and wherein the corner has provision for receiving extra material.

According to one embodiment of the present invention, there is provided, a corner guard arrangement for a box spring, the corner guard arrangement comprising a first member formed of a sheet material, a first end of the first member having attachment means for securing the member to a wire of the box spring, a second member formed of a sheet material, and first end of the second member having second attachment means for securing the member to a wire of the box spring, the first and second members each having interlocking means, the interlocking means being arranged to maintain the first and second members together when in an assembled condition while permitting sliding movement of the first and second members with respect to each other, the arrangement being such that when the first and second members are assembled, the first end of the first member and the second end of the second member can be secured to top and bottom wires respectively of the box spring.

According to a further aspect of the present invention, in a box spring having a plurality of wires forming a plurality of coils, with an outer perimeter wire extending about the top and bottom thereof, the improvement comprising a corner guard, the corner guard comprising a first member formed of a sheet material, a first end of the first member being secured to an upper perimeter wire of the box spring, a second member formed of sheet material, a second end of the second member being secured to a lower perimeter wire of said box spring, the first and second members being interlocked together, the interlocking means permitting sliding movement of the first and second members with respect to each other.

According to a further aspect of the present invention, there is provided a corner guard for a box spring, the corner guard comprising a first member formed of a sheet material, a first end of the first member having attachment means for securing the member to a wire of the box spring, the first member being formed to have an arcuate configuration wherein that arcuate configuration has a radius which is larger than a radius of a box spring corner, the attachment means for securing the member comprising a plurality of retaining members extending outwardly from the first end of the first member, each of the retaining members comprising an outwardly extending portion and a downwardly extending portion defining, with the first member a U-shaped recess and at least one pointed member located on the outwardly extending portion to engage a fabric placed on the box spring.

In a still further aspect of the present invention, there is provided a guard member for a box spring, the guard member comprising a first member formed of a sheet material, a first end of the first member having attachment means for securing the member to a wire of the box spring, the attachment means comprising a plurality of retaining members extending outwardly from the first end of the first member, each of the retaining members comprising an outwardly extending portion and a downwardly extending portion defining, together with the first member, a converted U-shaped recess, the first member having an arcuate configuration with a radius which is larger than a radius of a box spring corner and the first member having an aperture centrally located on the first member.

The corner guard arrangement, as set forth above, comprises first and second members which are formed of a sheet material and preferably of a plastic sheet material, many of which are well known to those skilled in the art. Each of the members is preferably formed to have a body portion which is arcuate in configuration, but has a greater radius than the radius of a box spring corner. In so doing, the member will exert a slight outward force when it is placed in position on the box spring corner.

The two members are interlocked in a relationship which permits sliding movement therebetween. Accordingly, the device can be adjusted for different sizes of box springs.

In one embodiment of the present invention, the corner guard includes upwardly extending relatively pointed members for retaining a fabric material which is placed thereover. While normally the corner guard will be placed on the exterior of the box spring, it can also be placed on the interior thereof for retaining the material. If desired, an additional corner guard could be placed on the exterior.

In a still further embodiment of the present invention, the corner guard may include downwardly extending relatively pointed members for retaining a fabric material which is placed thereon.

In a still further arrangement, the corner guard could include both downwardly and upwardly extending relatively pointed members for retaining a fabric material below the corner guard and a further fabric material placed over the corner guard.

In a still further aspect of the present invention, a corner guard is provided with a centrally located aperture, which centrally located aperture is suitable for receiving excess material such that a smooth arcuate appearance is maintained.

BRIEF DESCRIPTION OF THE DRAWINGS

Having thus generally described the invention, reference will be made to the accompanying drawings illustrating an embodiment thereof, in which:

FIG. 15 is a top plan view thereof;

FIG. 16 is a rear elevational view of a still further embodiment of a corner guard according to the present invention;

FIG. 17 is a side elevational view thereof; and

FIG. 18 is a front elevational thereof.

DESCRIPTION OF THE PREFERRED EMBODIMENTS

Figure 1:
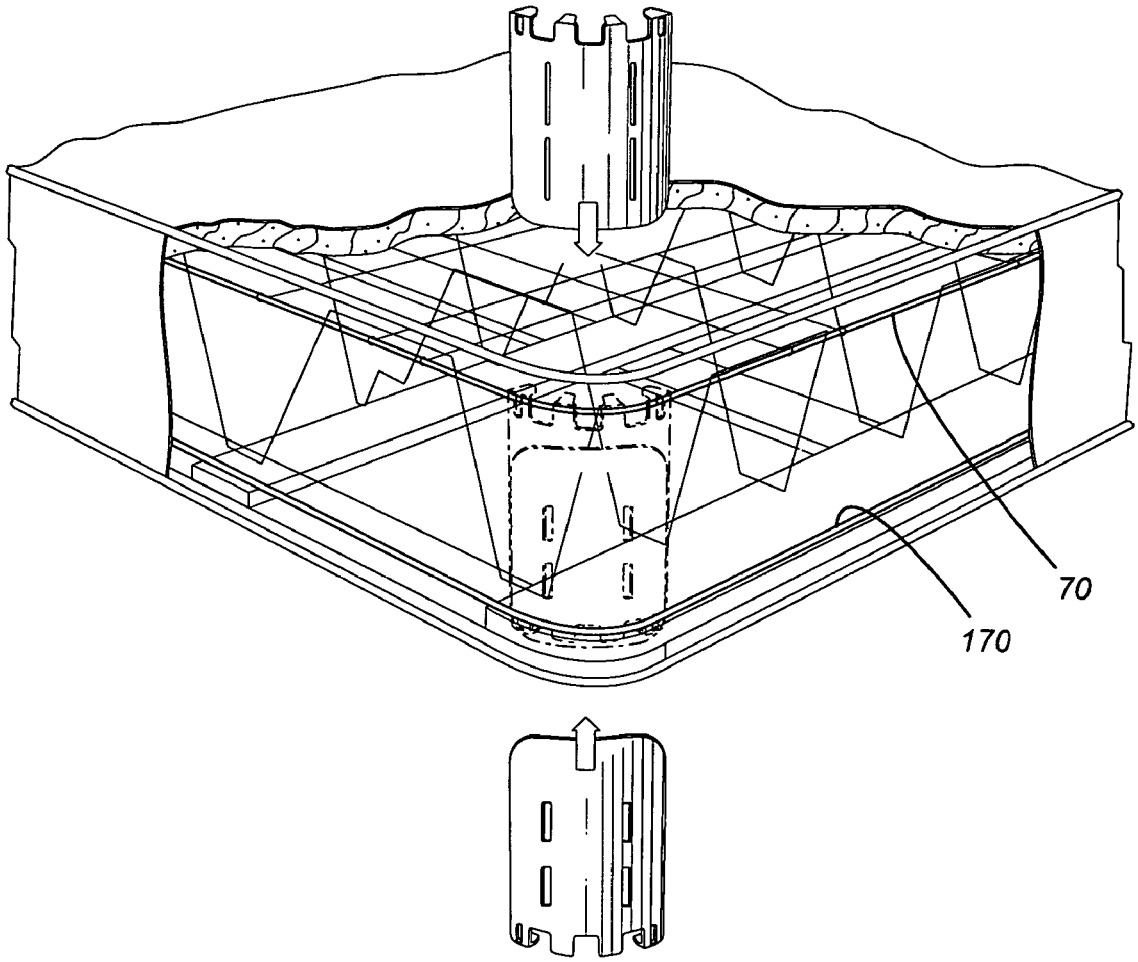
FIG. 1 is a perspective view, partially in cut-away, of a corner portion of a box spring.
Figure 2:
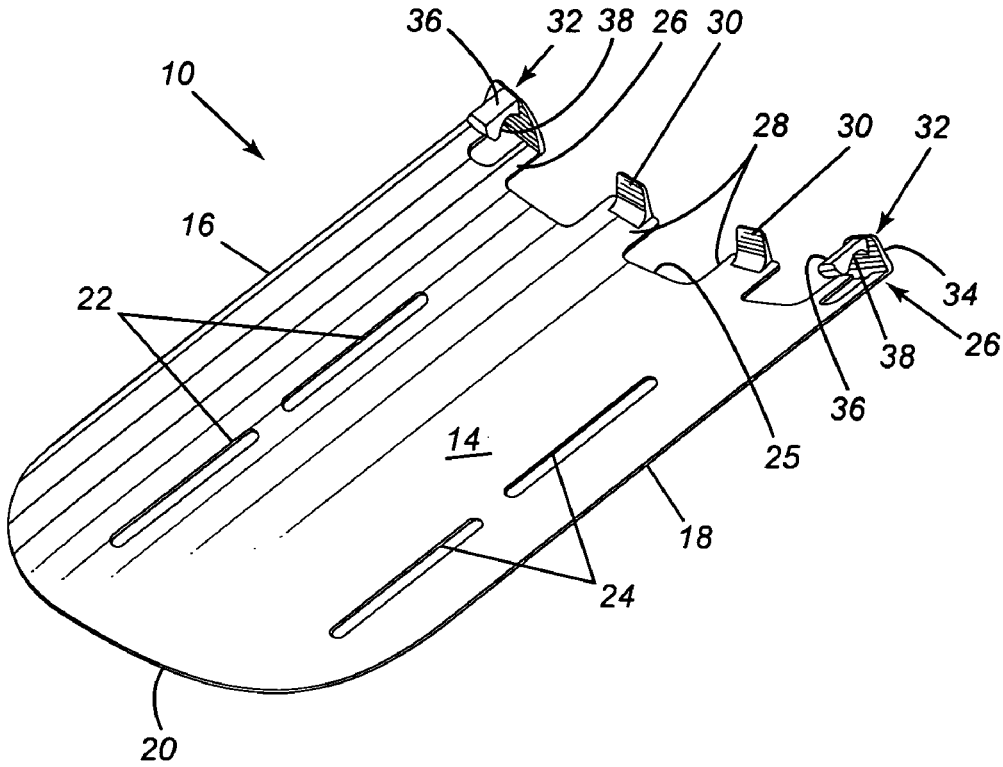
FIG. 2 is a perspective view of a first member of a corner guard according to the present invention.
Figure 3:
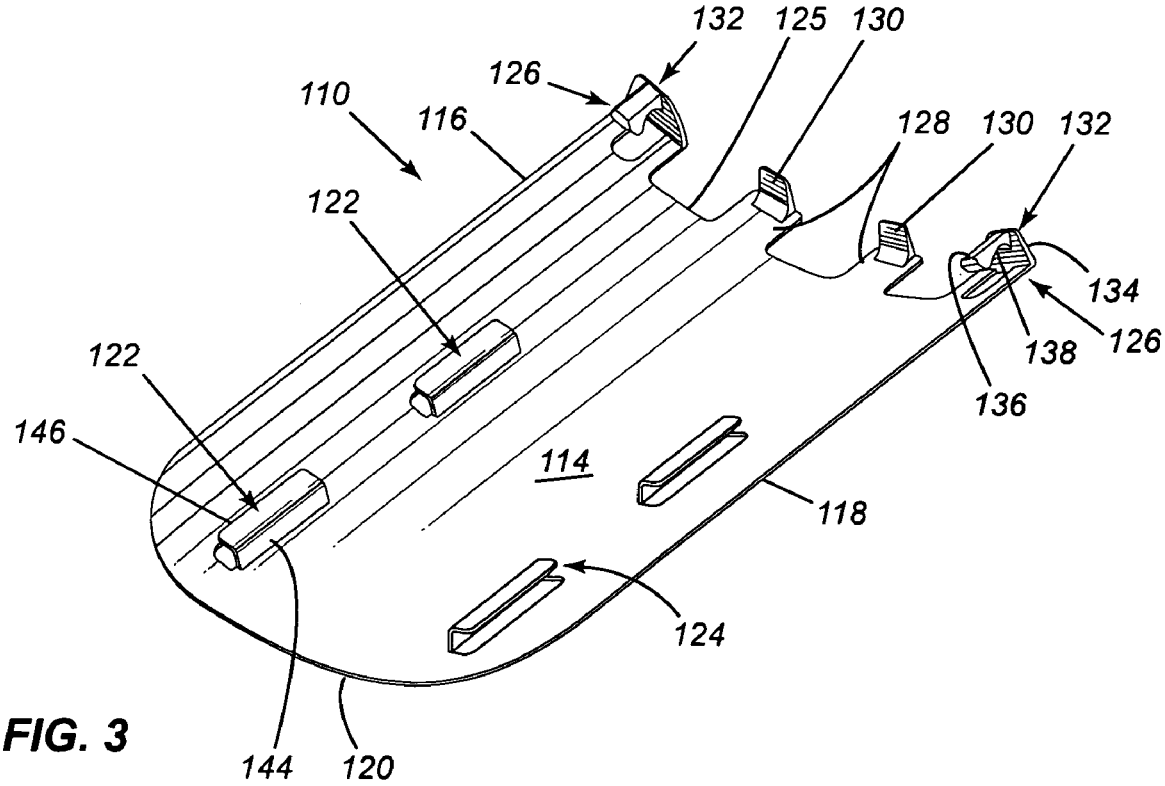
FIG. 3 is a perspective view of the second member.

Referring to the drawings in greater detail, the corner guard of the present invention comprises first and second members generally designated by reference numerals 10 and 110 respectively.

First member 10 has a main body portion 14 which is defined by a pair of side edges 16, 18 and a bottom edge 20. Formed within main body portion 14 are two sets of vertically aligned slots 22, 24. At an upper marginal edge 25, main body portion 14 has a pair of outer legs 26 and a pair of inner legs 28. Inner legs 28 each have of a flange 30 extending outwardly while outer legs 26 each comprise a retaining member 32.

Each retaining member 32 comprises an outwardly extending portion 34 and a downwardly extending portion 36 which together with the main body of first member 10 defines a U-shaped configuration. Downwardly extending portion 36 includes a concave recess 38.

Second member 110 also has a main body portion 114. Main body portion 114 is defined by side edges 116, 118 along with a bottom edge 120. Extending outwardly from main body portion 114 are two sets of vertically aligned projections 122, 124. Each of the projections 122, 124 comprise a first perpendicular portion 144, and a second portion 146 which together give each of projections 122, 124 a generally L-shaped configuration.

At a lower marginal edge 125, main body portion 114 has a pair of outer legs 126 and a pair of inner legs 128. Inner legs 128 each have a flange 130 extending outwardly while outer legs 126 each comprise a retaining member 132. Each retaining member 132 has an outwardly extending portion 134 and a downwardly extending portion 136 which, together with main body portion 114, define a U-shaped recess. A concave recess 138 is formed in downwardly extending portion 136.

According to this embodiment of the present invention, there is provided a reinforcing member generally designated by reference numeral 122 and which reinforcing member 122 as a main body portion 124 formed of a sheet material. As in the previously described embodiment, body portion is of an overall arcuate configuration.

Extending outwardly from main body portion 24 at one end thereof is a flange 26. In this embodiment, on flange 126, there are provided a plurality of downwardly extending members 138, each of which has a sharp end.

Figure 4:
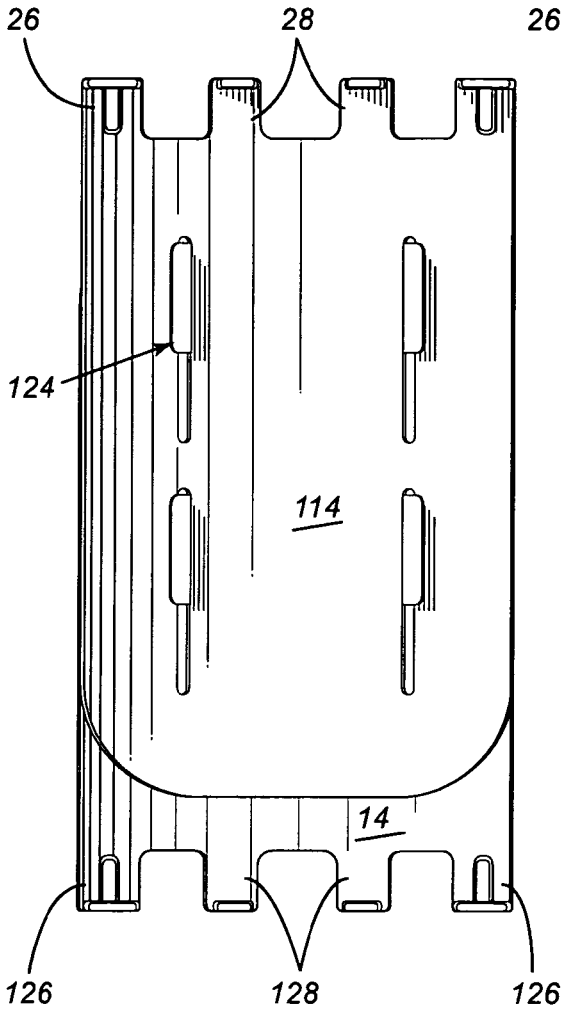
FIG. 4 is a front elevational view of the corner guard of the present invention in a retracted position.
Figure 5:
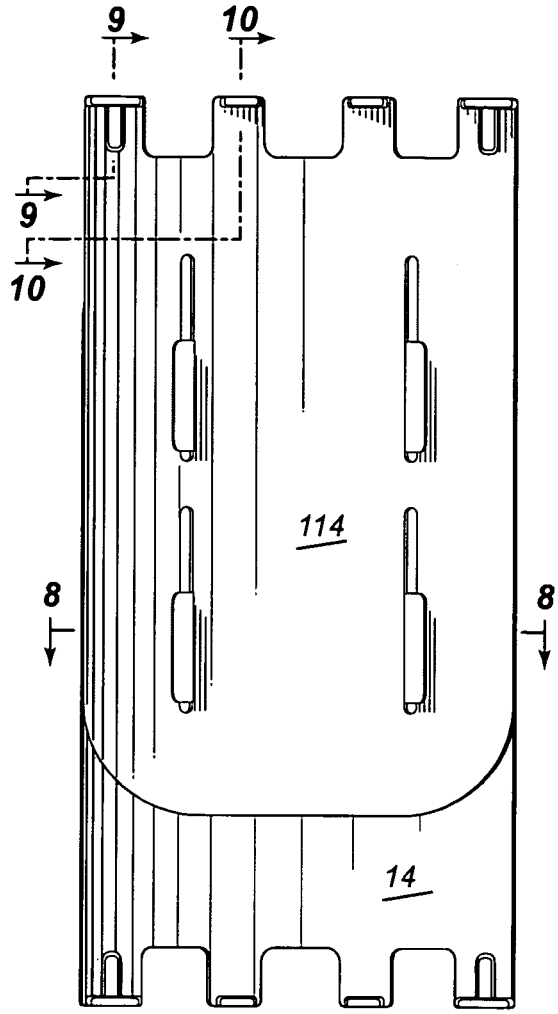
FIG. 5 is a front elevational view thereof in an extended position.
Figure 6:
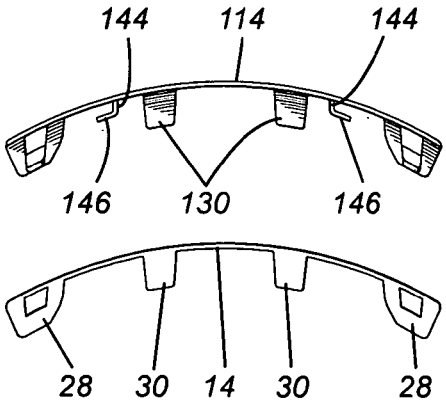
FIG. 6 is a top plan view of the first and second members.
Figure 7:
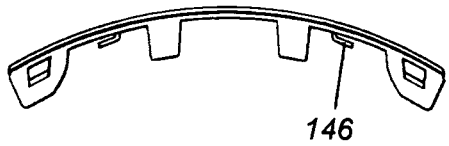
FIG. 7 is a bottom plan view thereof.
Figure 8:
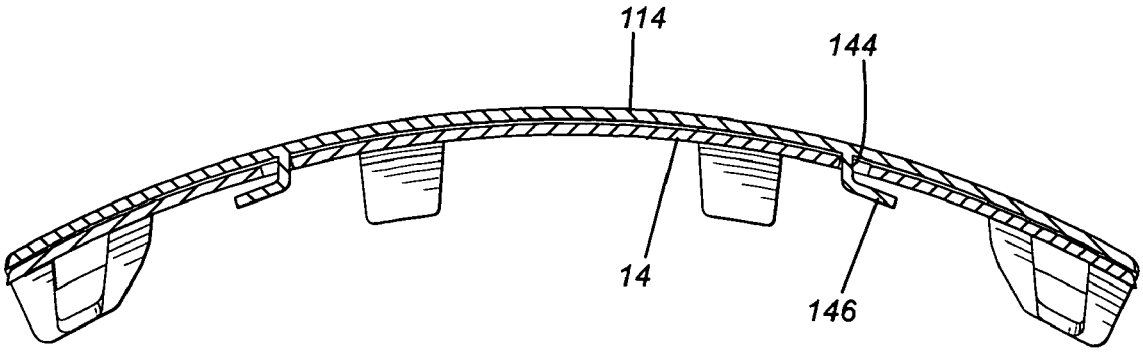
FIG. 8 is a cross sectional view taken along the lines 8—8 of FIG. 5.
Figure 9:
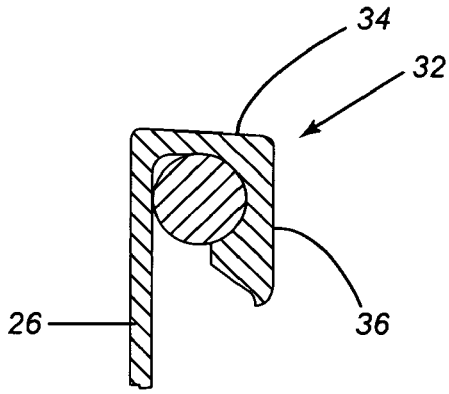
FIG. 9 is a cross sectional view taken along the lines 9—9 of FIG. 5.
Figure 10:
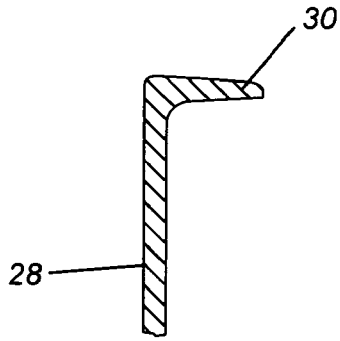
FIG. 10 is a cross sectional view taken along the lines 10—10 of FIG. 5.
Figure 11:
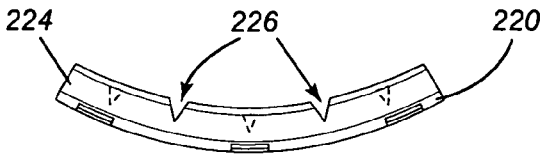
FIG. 11 is a top plan view of a corner guard according to a further embodiment of the present invention.
Figure 12:
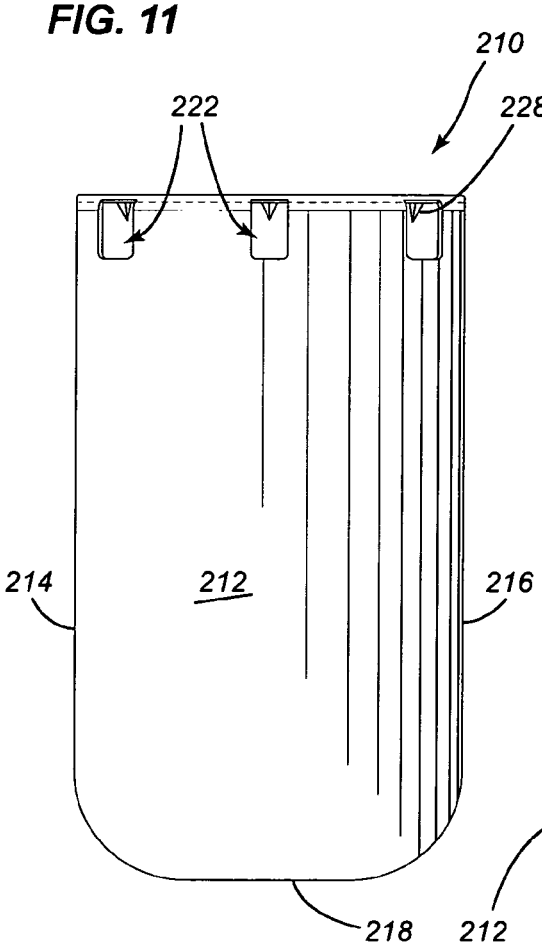
FIG. 12 is a rear elevational view of a corner guard according to a further embodiment of the present invention.
Figure 13:
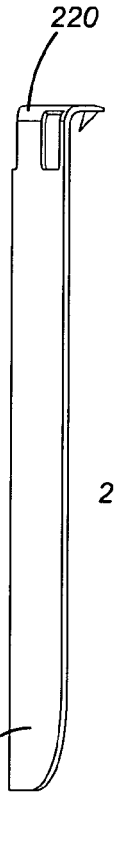
FIG. 13 is a side elevational view thereof.
Figure 14:
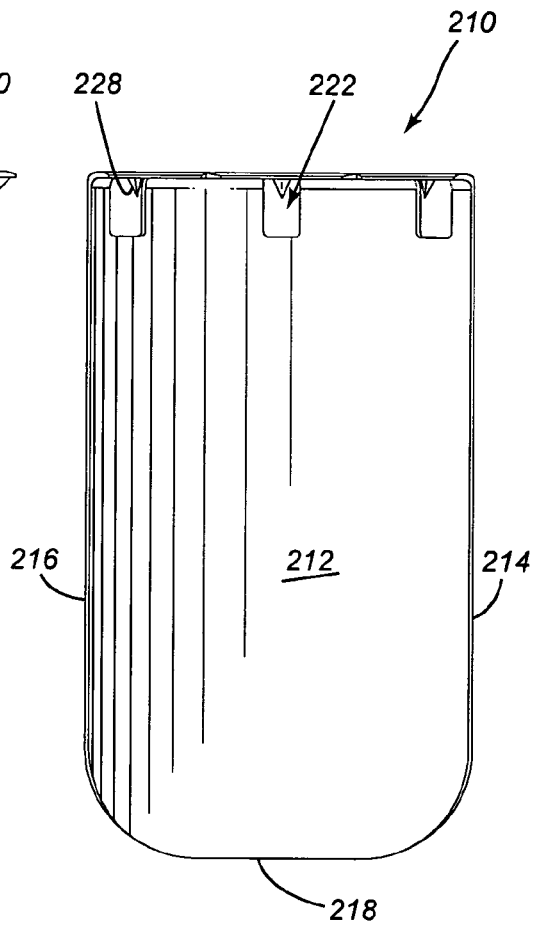
FIG. 14 is a front elevational view thereof.

In use, the two members are assembled together as shown in FIGS. 4 and 5 with the upper retaining members 32 being hooked on and retained by an upper perimeter wire 70 while retainer members 132 are hooked on lower perimeter wire 170.

Referring now to FIGS. 11 to 18, there is illustrated a corner guard which is generally designated by reference numeral 210.

Corner guard 210 has a main body portion 212 which is formed of a sheet material and which has an overall arcuate configuration. Main body portion 212 is defined by a first side edge 214, a second side edge 216, a bottom edge 218 and a top edge 220. As may be seen in FIGS. 12 and 14, a plurality of apertures 222 are provided in the top portion of main body 212 along top edge 220.

Extending outwardly from top edge 220 and substantially perpendicular thereto, is a flange 224.

Flange 224 has two cut out portions generally designated by reference numeral 226 and which separate the flange into three different sections. Extending downwardly from each section of flange 224 is a tooth member 228.

Turning to the embodiment of FIGS. 15 to 18, there is illustrated a flange similar to that of FIGS. 11 to 14. In this embodiment, there is provided a central aperture generally designated by reference numeral 232. Aperture 232 is provided to allow excessive material to be placed therein.

It will be understood that the above described embodiment is for purposes of illustration only and that changes and modifications may be made thereto without departing from spirit and scope of the invention.

I claim:

1. A corner guard arrangement for a box spring, said corner guard arrangement comprising:

a first member formed of a sheet material;

a first end of said first member having attachment means for securing said member to a wire of said box spring;

a second member formed of a sheet material, an end of said second member having second attachment means for securing said member to a wire of said box spring;

said first and second members each having interlocking means, said interlocking means being arranged to maintain said first and second members together when in an assembled condition while permitting sliding movement of said first and second members with respect to each other, the arrangement being such that when said first and second members are assembled, said first end of said first member and said second end of said second member can be secured to top and bottom wires respectively of the box spring.

2. The corner guard arrangement of claim 1 wherein each of said first and second members are formed of a flexible plastic material.

3. The corner guard arrangement of claim 2 wherein each of said first and second members are formed to have an arcuate configuration, each of said first and second members having a radius which is larger than a radius of a box spring corner.

4. The corner guard arrangement of claim 2 wherein said interlocking means comprises a plurality of slots formed in one of said members and a plurality of projections formed in a second one of said members, said projections extending through said slots.

5. The corner guard arrangement of claim 4 wherein said projections comprise L-shaped elements.

6. The corner guard arrangement of claim 2 wherein said attachment means on each of said first and second members comprises a plurality of retaining members extending outwardly from said first end of said first member and said second end of said second member, each of said retaining members comprises an outwardly extending portion and a downwardly extending portion defining, together with first and second members respectively U-shaped recesses.

7. The corner guard arrangement of claim 6 wherein each of said downwardly extending portions has a concave shaped wall.

8. In a box spring having a plurality of wires forming a plurality of coils, with outer perimeter wires extending about the top and bottom thereof, the improvement comprising a corner guard, said corner guard comprising:

a first member formed of a sheet material, a first end of said first member being secured to an upper perimeter wire of said box spring;

a second member formed of sheet material, a second end of said second member being secured to a lower perimeter wire of said box spring;

said first and second members being interlocked together, said interlocking of said first and second members permitting sliding movement of said first and second members with respect to each other.

9. A corner guard for a box spring, said corner guard comprising:

a first member formed of a sheet material;

a first end of said first member having attachment means for securing said member to a wire of said box spring;

said first member being formed to have an arcuate configuration wherein that arcuate configuration has a radius which is larger than a radius of a box spring corner;

said attachment means for securing said member comprising a plurality of retaining members extending outwardly from said first end of said first member, each said retaining members comprising an outwardly extending portion and a downwardly extending portion defining, with said first member a U-shaped recess; and at least one pointed member located on said outwardly extending portion to engage a fabric placed on said box spring.

10. A guard member for a box spring, said guard member comprising:

a first member formed of a sheet material;

a first end of said first member having attachment means for securing said member to a wire of said box spring, said attachment means comprising a plurality of retaining members extending outwardly from said first end of said first member, each said retaining members comprising an outwardly extending portion and a downwardly extending portion defining, together with said first member, an inverted U-shaped recess;

said first member having an arcuate configuration with a radius which is larger than a radius of a box spring corner; and said first member having an aperture centrally located on said first member.

* * * * *